US008500917B2

(12) United States Patent
Kramer

(10) Patent No.: US 8,500,917 B2
(45) Date of Patent: Aug. 6, 2013

(54) WAREWASHER AND ASSOCIATED DOOR CONSTRUCTION

(75) Inventor: Steven Henry Kramer, Osgood, OH (US)

(73) Assignee: Premark FEG L.L.C., Glenview, IL (US)

( * ) Notice: Subject to any disclaimer, the term of this patent is extended or adjusted under 35 U.S.C. 154(b) by 1130 days.

(21) Appl. No.: 12/015,027

(22) Filed: Jan. 16, 2008

(65) Prior Publication Data

US 2008/0210277 A1 Sep. 4, 2008

Related U.S. Application Data

(60) Provisional application No. 60/889,032, filed on Feb. 9, 2007.

(51) Int. Cl.
*B08B 13/00* (2006.01)

(52) U.S. Cl.
USPC ..... 134/56 D; 134/57 D; 134/58 D; 134/114; 134/198

(58) Field of Classification Search
USPC ..... 134/198, 56 D, 57 D, 58 D, 114
See application file for complete search history.

(56) References Cited

U.S. PATENT DOCUMENTS

| | | | | |
|---|---|---|---|---|
| 2,106,619 | A | 1/1938 | Merrill | |
| 3,122,151 | A | 2/1964 | Chambers | |
| 3,220,426 | A | 11/1965 | Brucken | |
| 4,143,669 | A | 3/1979 | Minkin | |
| 4,310,991 | A * | 1/1982 | Seely | 49/470 |
| 4,608,780 | A | 9/1986 | Van Noy | |
| 4,617,759 | A * | 10/1986 | Pasqualini et al. | 49/478.1 |
| 4,750,503 | A | 6/1988 | Noren | |
| 4,781,206 | A | 11/1988 | Noren | |

(Continued)

FOREIGN PATENT DOCUMENTS

| | | | |
|---|---|---|---|
| DE | 19805066 | A1 | 8/1999 |
| DE | 10208494 | A1 | 10/2003 |
| DE | 102005034408 | A1 | 2/2007 |
| FR | 2795125 | A1 * | 12/2000 |

OTHER PUBLICATIONS

Muller, Carranza Luis; FR 2795125 A1; Dec. 2000; Machine Translation.*
Ecker; DE 102005034408 A1; Feb. 1, 2007; Machine Translation.*

(Continued)

*Primary Examiner* — Michael Barr
*Assistant Examiner* — Benjamin L Osterhout
(74) *Attorney, Agent, or Firm* — Thompson Hine LLP

(57) ABSTRACT

A warewasher for washing wares including a housing defining an internal space with at least one spray zone for washing wares. The housing includes an opening defined in part by a lower shelf. A liquid delivery system provides a spray of liquid within the spray zone. An access door has a vertically hinged connection to the housing to provide an open configuration that allows user access to the spray zone and a closed configuration that inhibits user access to the spray zone. The access door includes a threshold seal member at the bottom of the access door. The threshold seal member includes a lower sealing portion that mates with an upper surface of the shelf to provide a lower seal extending laterally along a width of the access door, and an inner sealing portion that cooperates with an inner edge the shelf to provide an inner seal extending laterally along the width of the access door. The inner seal located nearer the spray zone than the lower seal.

15 Claims, 9 Drawing Sheets

U.S. PATENT DOCUMENTS

| | | | | |
|---|---|---|---|---|
| 4,998,550 | A | 3/1991 | Archambault | |
| 5,257,638 | A | 11/1993 | Alvemarker | |
| 5,359,795 | A * | 11/1994 | Mawby et al. | 40/405 |
| 5,482,064 | A | 1/1996 | Goddard | |
| 5,496,104 | A * | 3/1996 | Arnold et al. | 312/204 |
| 5,524,653 | A | 6/1996 | Minkin et al. | |
| 5,529,080 | A | 6/1996 | Minkin | |
| 5,630,438 | A | 5/1997 | Hoover et al. | |
| 6,006,767 | A * | 12/1999 | Hecker et al. | 134/183 |
| 6,578,587 | B2 | 6/2003 | Matsuno et al. | |
| 6,647,997 | B2 | 11/2003 | Mohn | |
| 6,684,457 | B2 * | 2/2004 | Holt | 16/387 |
| 6,918,398 | B2 | 7/2005 | Edelmann et al. | |
| 7,128,075 | B2 | 10/2006 | Publ | |
| 2004/0238018 | A1 | 12/2004 | Melotti | |
| 2004/0250837 | A1 | 12/2004 | Watson et al. | |
| 2005/0022847 | A1 | 2/2005 | Nito et al. | |
| 2005/0028850 | A1 | 2/2005 | Nito et al. | |
| 2005/0077399 | A1 | 4/2005 | Watson et al. | |
| 2006/0037631 | A1 | 2/2006 | Kramer | |

OTHER PUBLICATIONS

DE 10-2005-034-408.9, Filed Jul. 22, 2005 Published Feb. 1, 2007; Abstract and Claims Translation.

* cited by examiner

WAREWASHER AND ASSOCIATED DOOR CONSTRUCTION

CROSS-REFERENCE TO RELATED APPLICATIONS

This application claims priority to U.S. Provisional Patent Application Ser. No. 60/889,032, filed Feb. 9, 2007, the details of which are incorporated by reference.

TECHNICAL FIELD

This application relates generally to warewasher systems which are used in commercial applications such as cafeterias and restaurants and, more particularly, to such a warewash system with associated door construction.

BACKGROUND

Commercial warewashers commonly include a housing area which defines the washing and rinsing area for dishes, pots pans and other wares. Liquid is typically pumped from a tank through a pump intake and delivered to lower and/or upper wash arms that direct the liquid onto the wares. In some embodiments, the warewashers may include access doors for gaining access to components of the warewasher. For example, it may be desirable to gain access to the housing area to remove the wash arms from the warewasher to clean them.

SUMMARY

In an aspect, a warewasher for washing wares including a housing defining an internal space with at least one spray zone for washing wares. The housing includes an opening defined in part by a lower shelf. A liquid delivery system provides a spray of liquid within the spray zone. An access door has a vertically hinged connection to the housing to provide an open configuration that allows user access to the spray zone and a closed configuration that inhibits user access to the spray zone. The access door includes a threshold seal member at the bottom of the access door. The threshold seal member includes a lower sealing portion that mates with an upper surface of the shelf to provide a lower seal extending laterally along a width of the access door, and an inner sealing portion that cooperates with an inner edge the shelf to provide an inner seal extending laterally along the width of the access door. The inner seal located nearer the spray zone than the lower seal.

In another aspect, a warewasher for washing wares includes a housing defining an internal space with at least one spray zone for washing wares. The housing includes an opening defined in part by a lower shelf having a groove therein. A liquid delivery system provides a spray of liquid within the spray zone. An access door has a vertically hinged connection to the housing to provide an open configuration that allows user access to the spray zone and a closed configuration that inhibits user access to the spray zone. The vertically hinged connection permits some vertical movement of the access door along its hinge axis. The access door includes a threshold seal member at the bottom of the access door. The threshold seal member includes a downwardly extending rib that locates within the groove to provide a lower seal extending laterally along a width of the access door. During opening of the access door, the rib rides upward along the shelf and out of the groove causing the door to move vertically upward.

In another aspect, a warewasher for washing wares includes a housing defining an internal space with at least one spray zone for washing wares. The housing includes an opening defined in part by a lower shelf having a groove therein. A liquid delivery system provides a spray of liquid within the spray zone. A tank is located beneath the spray zone, the tank including the lower shelf. An access door has a vertically hinged connection to the housing to provide an open configuration that allows user access to the spray zone and a closed configuration that inhibits user access to the spray zone. The vertically hinged connection permits some vertical movement of the access door along its hinge axis. A labyrinth seal assembly extends vertically along a vertically oriented edge of the access door. The labyrinth seal assembly including a channel extending along a height of the access door. The channel is in communication with the spray zone so that liquid entering the channel along a leak path formed between the access door and the labyrinth seal assembly with the access door in its closed configuration drains down into the tank.

The details of one or more embodiments are set forth in the accompanying drawings and the description below. Other features, objects, and advantages will be apparent from the description and drawings, and from the claims.

DETAILED DESCRIPTION

Figure 1:
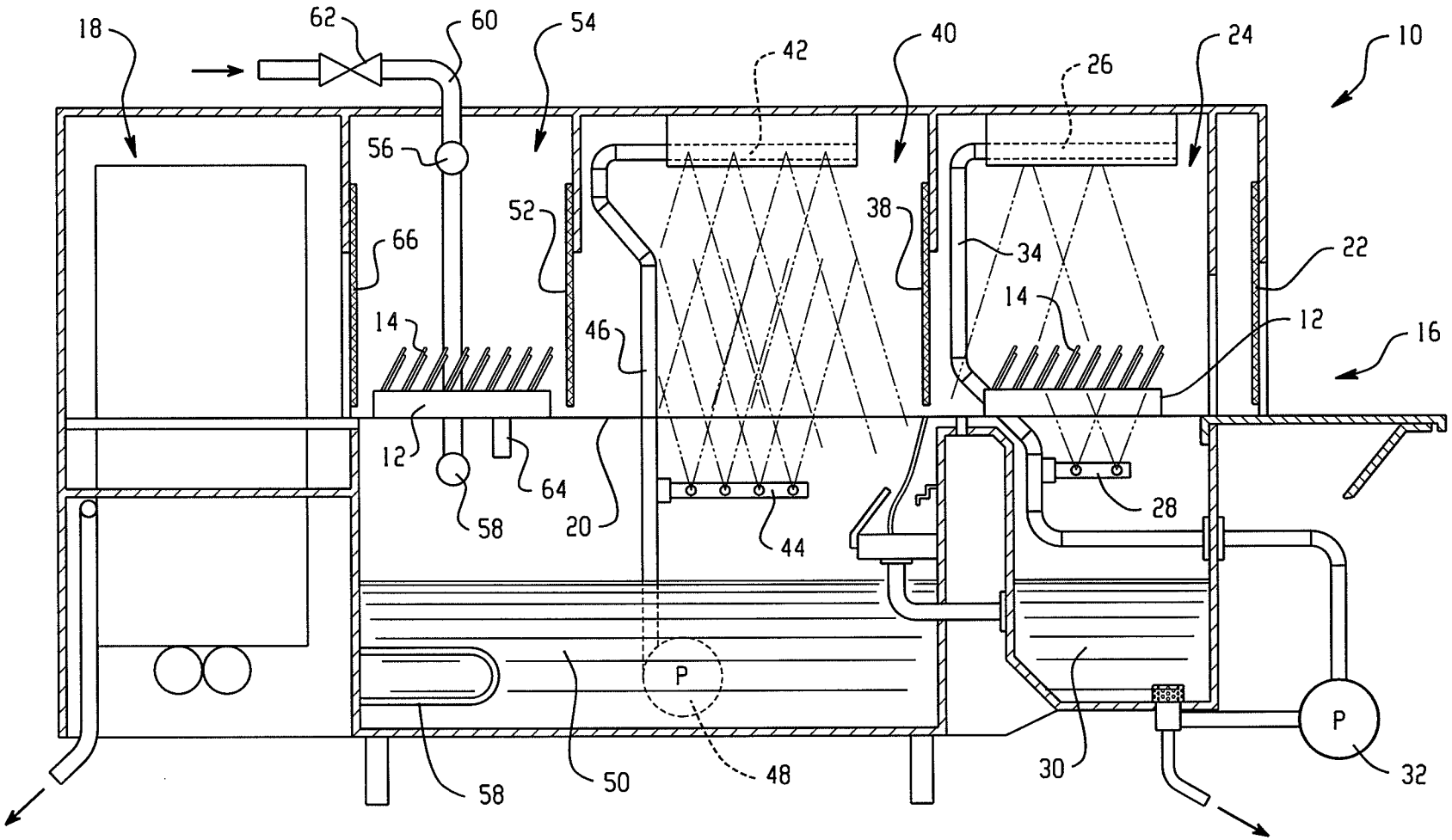
FIG. 1 is a diagrammatic side, section view of an embodiment of a warewash system.

Referring to FIG. 1, an exemplary conveyor-type warewash system, generally designated 10, is shown. Warewash system 10 can receive racks 12 of soiled wares 14 from an operator side 16 which are moved through tunnel-like chambers from the operator side toward a dryer unit 18 at an opposite end of the warewash system by a suitable conveyor mechanism 20. Either continuously or intermittently moving conveyor mechanisms or combinations thereof may be used, depending, for example, on the style, model and size of the warewash system 10. The racks 12 of soiled wares 14 enter the warewash system 10 through a flexible curtain 22 into a pre-wash chamber 24 where sprays of liquid from upper and lower pre-wash manifolds 26 and 28 above and below the racks, respectively, function to flush heavier soil from the wares. The liquid for this purpose comes from a tank 30 via a pump 32 and supply conduit 34.

The racks proceed next to a curtain 38 into the main wash chamber 40, where the wares are subject to sprays of cleansing liquid from upper and lower wash manifolds 42 and 44, respectively, these sprays being supplied through a supply conduit 46 by a pump 48, which draws from a main tank 50. A heater 58, such as an electrical immersion heater provided with suitable thermostatic controls (not shown), maintains the temperature of the cleansing liquid in the tank 50 at a suitable level. Not shown, but which may be included, is a device for adding a cleansing detergent to the liquid in tank 50. During normal operation, pumps 32 and 48 are continuously driven, usually by separate motors, once the warewash system 10 is started for a period of time.

The warewash system 10 may optionally include a power rinse chamber (not shown) that is substantially identical to main wash chamber 40. In such an instance, racks of wares proceed from the wash chamber 40 into the power rinse chamber, within which heated rinse water is sprayed onto the wares from upper and lower manifolds.

The racks 12 of wares 14 exit the main wash chamber 40 through a curtain 52 into the final rinse chamber 54. The final rinse chamber 54 is provided with upper and lower spray heads or arms 56, 58 that are supplied with a flow of fresh hot water via pipe 60 under the control of solenoid valve 62. A rack detector 64 is actuated when rack 12 of wares 14 is positioned in the final rinse chamber 54 and through suitable electrical controls, the detector causes actuation of the solenoid valve 62 to open and admit the hot rinse water to the spray heads 56, 58. The water then drains from the wares into tank 50. The rinsed rack 12 of wares 14 then exit the final rinse chamber 54 through curtain 66, moving into dryer unit 18. Although not shown in FIG. 1, any of the various sections of the warewash system 10 may include a side access door that provides access to the respective chamber. The access door can provide for user access to various components within the chamber and will be described in greater detail below.

Figure 2:
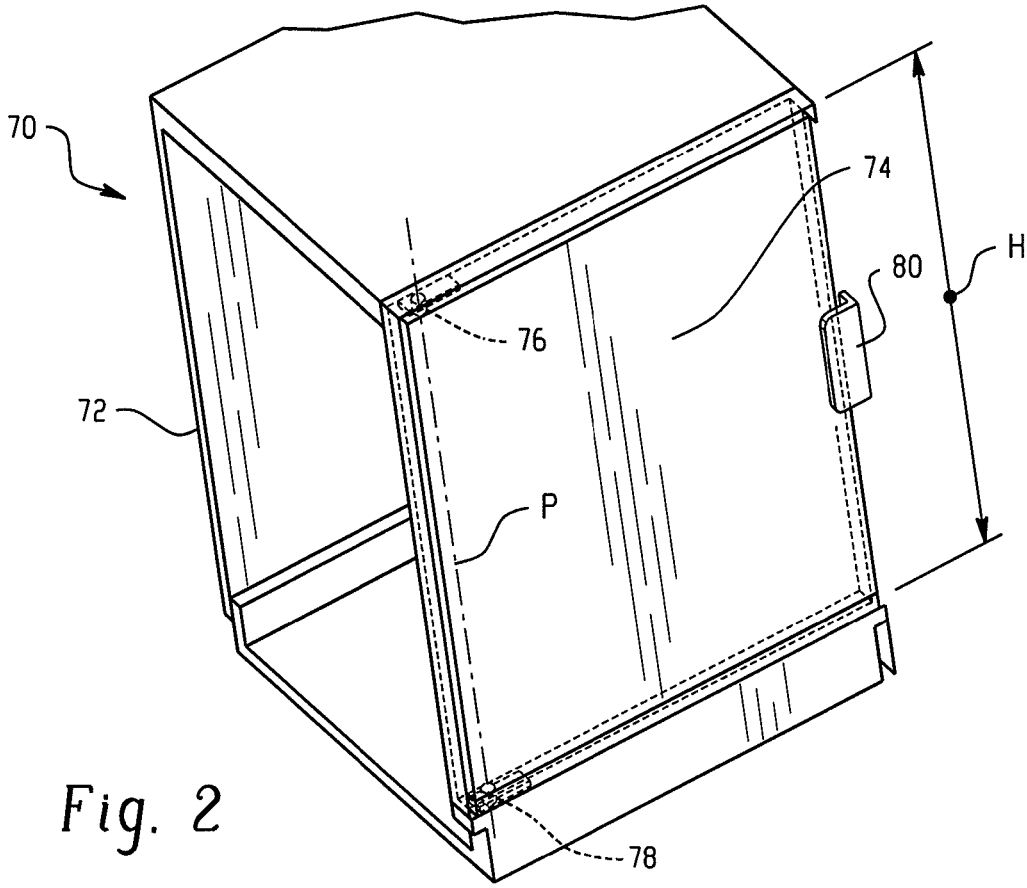
FIG. 2 is a partial, perspective view of an embodiment of a warewash section for use with the warewash system of FIG. 1.

Referring now to FIG. 2, warewash system 10 includes warewash section 70 which may, for example, be associated with any of the pre-wash chamber 24, main wash chamber 40, final rinse chamber 54, etc. The warewash section 70 includes a frame 72 and a side access door 74. Hinge pins 76 and 78 pivotally connect the door 74 to the frame 72, providing a pivot axis P so that the door is openable relative to the frame between closed (as shown) and opened configurations. A handle 80 is provided on the door 74 that can be grasped and pulled by an operator to open the door.

Figure 3:
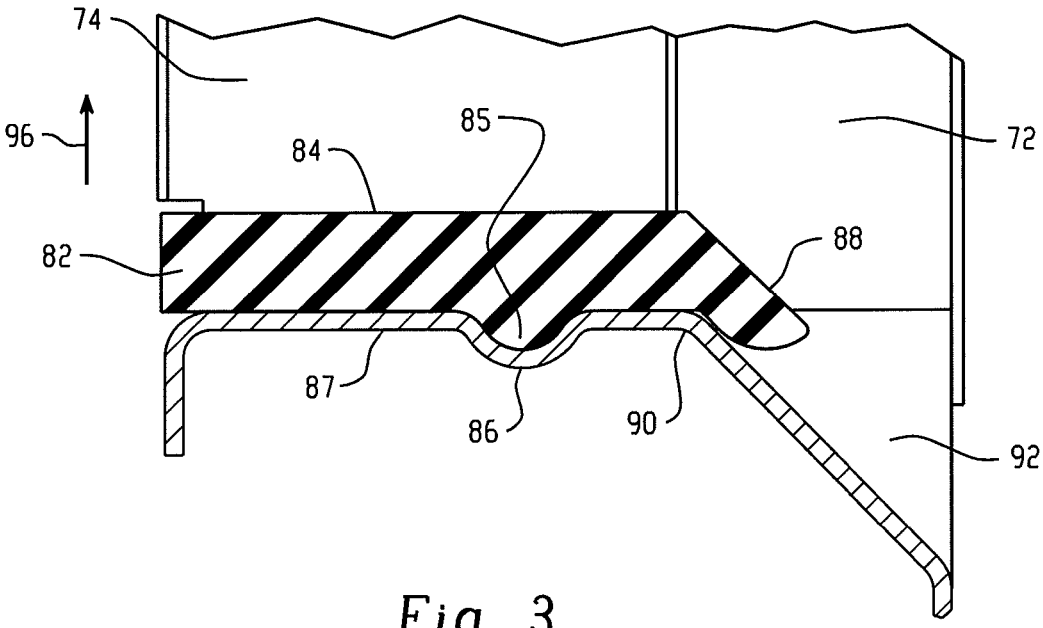
FIG. 3 is a section, detail view of the warewash section of FIG. 2 with a door in its closed configuration.

Referring to FIG. 3, the door 74 and frame 72 are shown in end view in the closed configuration. Door 74 includes a threshold seal member 82 (e.g., formed of hard rubber, plastic, etc.) that is connected to a bottom 84 of the door. Threshold seal member 82 includes an embossment 85 (e.g., a downward extended rib) that is sized and arranged to mate with a groove or recess 86 that is formed by tank shelf 87 to form an embossment seal and an edge seal member 88 that is sized and arranged to mate with an upper edge 90 of tank shelf 87 to form a tank edge seal. As can be appreciated, the embossment seal forms an outer seal that is spaced furthest away from the tank 92 and the edge seal forms an inner seal that is closest to the tank. The seals inhibit water and steam from escaping the chamber during use. Additionally, the mating between the groove 86 and the embossment 85 acts as a latch that inhibits unintended opening of the door 74.

Figure 4:
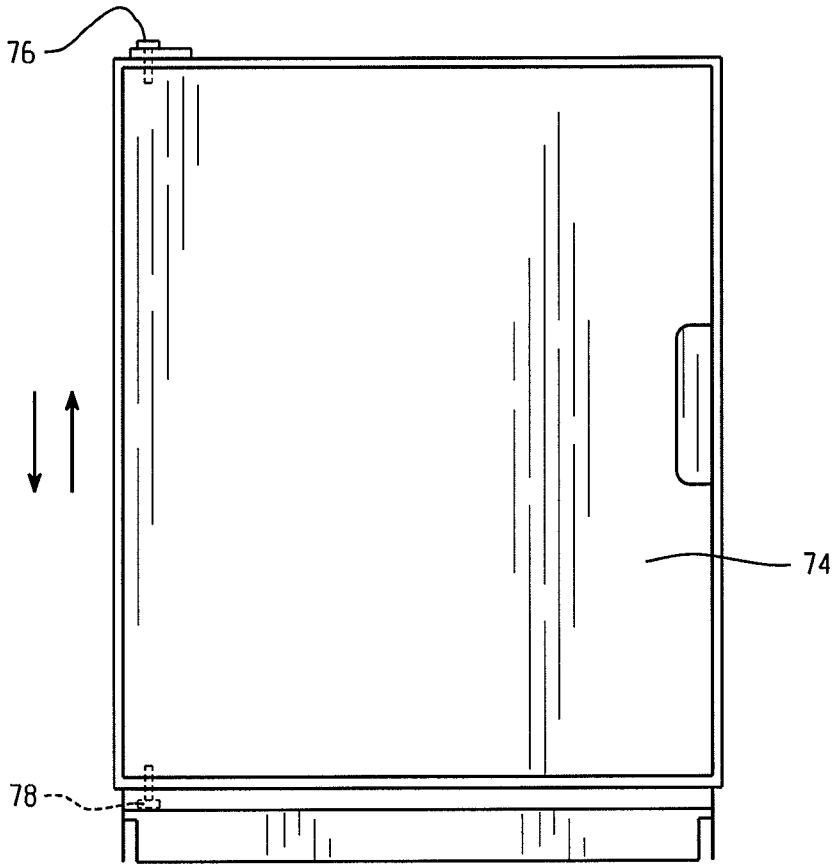
FIG. 4 is a partial, front view of the warewash section of FIG. 2 highlighting locations of pivot pins.
Figure 5:
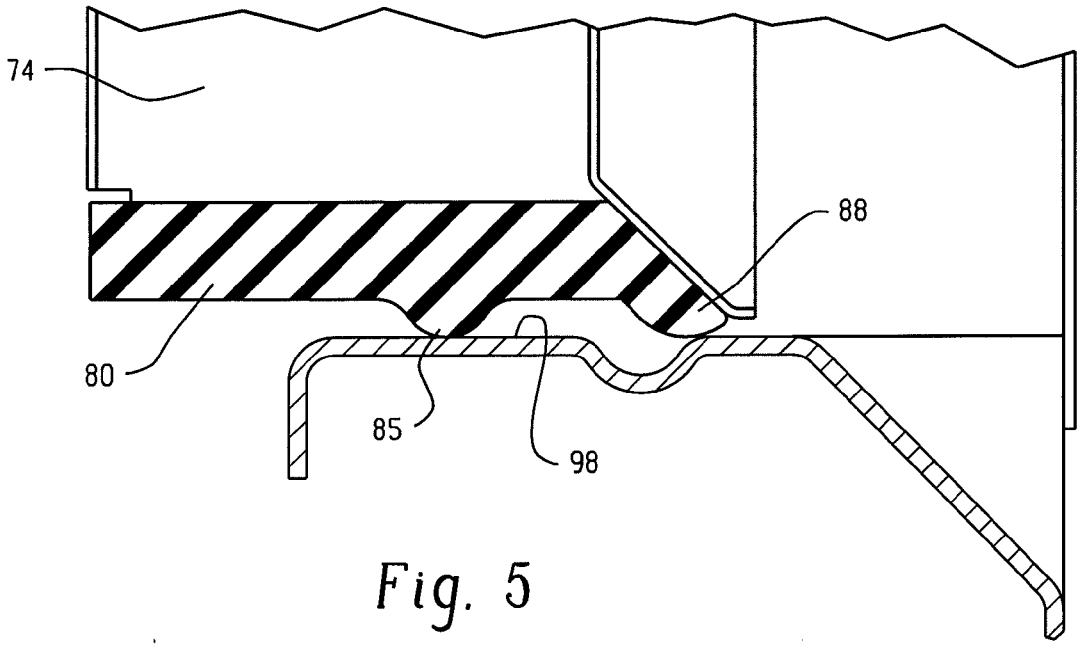
FIG. 5 is a section, detail view of the warewash section of FIG. 2 with the door in its open configuration.

Because threshold member 82 mates with the tank shelf 87, vertical movement of the door 74 in the direction of arrow 96 is desired in order to open the door. Referring to FIG. 4, hinge pins 76 and 78 and pin receiving openings in the door 74 are sized and positioned to allow for vertical movement of the door so that the embossment seal and tank edge seal can disengage. Referring to FIG. 5, the embossment 85 and edge seal member 88 rest against surface 98 with the door 74 in the open configuration. When the door 74 is placed back in the closed configuration as shown by FIG. 3, the door moves down once the embossment 85 is aligned with the groove 86 and the edge seal member 88 is aligned with the upper edge 90 of the tank shelf 87, forming the inner and outer seals.

Figure 6:
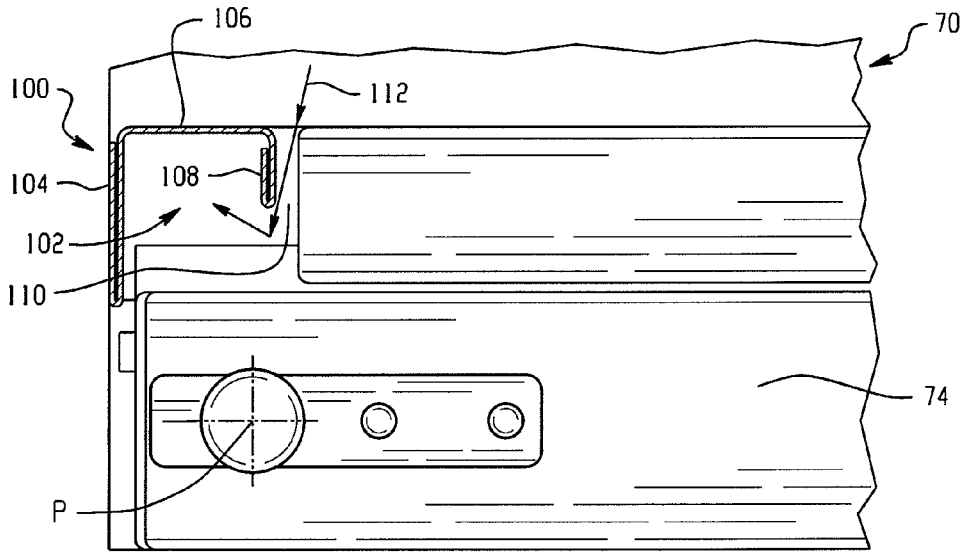
FIG. 6 is a detail, section view of the warewash section along line 6-6 of FIG. 2 with the door in its closed configuration.

Referring now to FIG. 6, warewash section 70 further includes a labyrinth seal assembly 100 located along the left and right sides of the door. Labyrinth seal assembly 100 includes an elongated channel 102 that is formed by an exterior wall 104, interior walls 106 and 108 and a lip or flange 107 extending inwardly of the door 74 when the door is in the closed orientation. The channel 102 extends along the height H (FIG. 2) of the door 74, is in communication with the chamber of the warewash section 70 and includes an opening 110 between the interior wall 108 and the door 74. In some embodiments, the walls 104, 106, 108 are formed using stainless steel, however other materials may be used. A similar labyrinth arrangement could be located at the top of the door.

Figure 7:
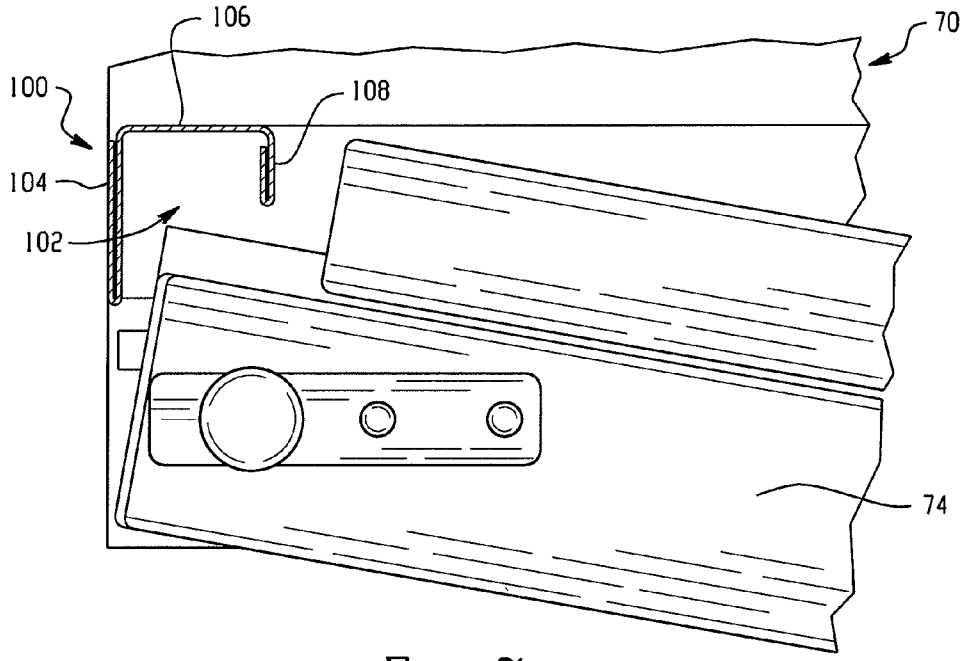
FIG. 7 is a detail, section view of the warewash section along line 6-6 of FIG. 2 with the door being opened.

Arrows 112 illustrate a tortuous steam and water leak path during use. Steam entering the channel 102 along the path condenses therein and drains down into the chamber of the warewash section 70. Labyrinth seal assembly 100 inhibits the escape of steam and water from the warewash section 70, which can allow for elimination of temporary rubber/plastic seals that may eventually break down and need replacement. In some embodiments, rubber and/or plastic seals may also be used with the labyrinth seal assembly 100. Referring to FIG. 7, the labyrinth seal assembly 100 is sized and arranged so that it does not interfere with opening of the door 74.

Figure 8:
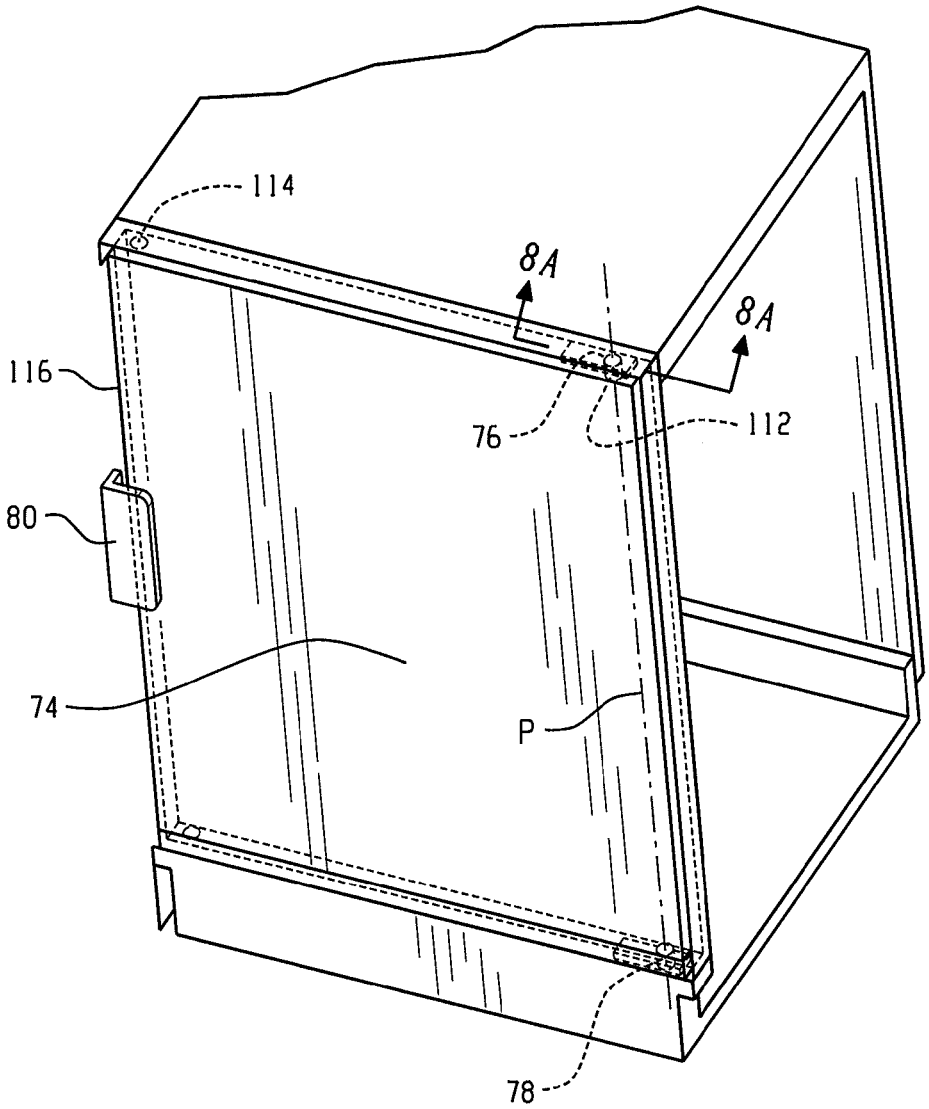
FIG. 8 illustrates the warewash section of FIG. 2 with the door being openable in a reverse direction.

Referring back to FIG. 2, in some embodiments, pivot axis P may be moved from the configuration illustrated to the configuration illustrated in FIG. 8. In other words, the configuration of the door 74 may be changed so that it can be opened in a reverse direction. In order to accomplish this, hinge pins 76 and 78 are removable from their locations in FIG. 2 to the locations in FIG. 8. Door 74 includes a second set of pin receiving openings 112 that are located at an opposite edge of the door from pin receiving openings 114. Handle 80 may also be made removable so that it can be repositioned at door edge 116 that is furthest from the pivot axis P. Alternatively, the hinge pins may be moved and the orientation of the door changed by simply rotating the door 180 degrees to place the handle at the opposite side, in which case the threshold member could also be moved.

Figure 8A:
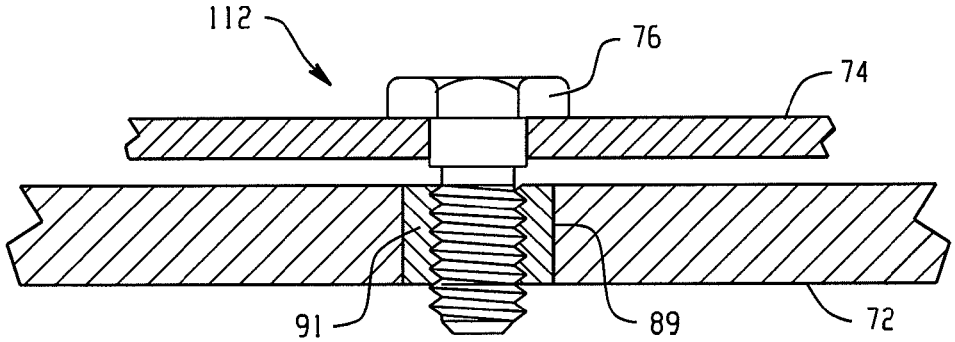
FIG. 8A is a side, detail view of an embodiment of a hinge pin connection arrangement.

Referring to FIG. 8A, the pin receiving openings 112, 114 are formed through the door 74 and the frame 72. A frame opening 89 can be hex-shaped (or another shape) to match the shape of a nut 91 that is fit with in the frame opening. The hex-shape of the frame opening 89 prevents the nut 91 from turning when tightening the hinge pin 76. This allows for hinge pin adjustment from outside the chamber.

Figure 9:
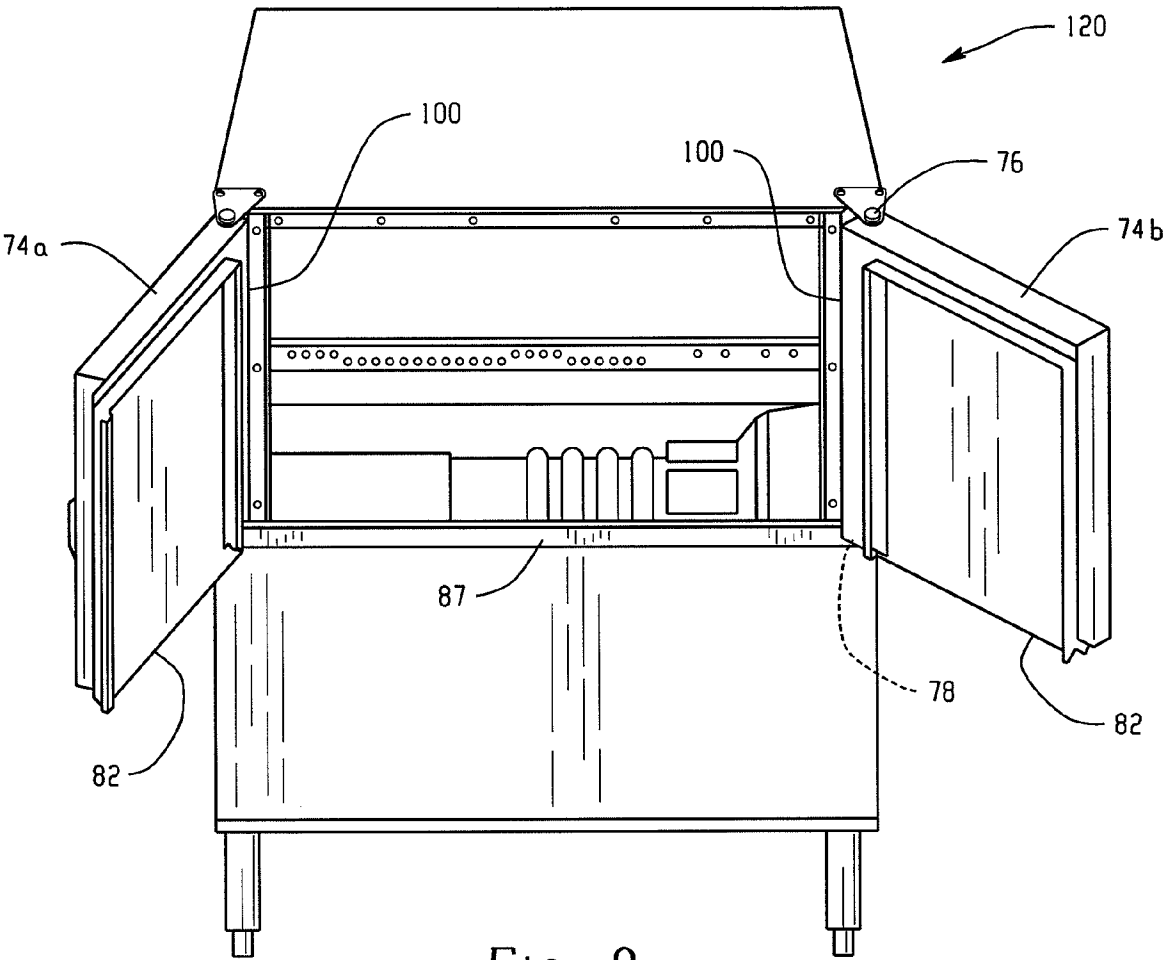
FIGS. 9-12 are various views of another embodiment of a warewash section including a double door configuration.

Referring to FIG. 9, an alternative warewash section 120 includes two doors 74*a* and 74*b* (shown in their open configurations). Each door 74*a* and 74*b* may include one, all or any combination of the features described above including the threshold member 82 that mates with the tank shelf 87, a hinged connection (e.g., using hinge pins 76 and 78) that allow for vertical movement of the door and the labyrinth seal 100.

Figure 10:
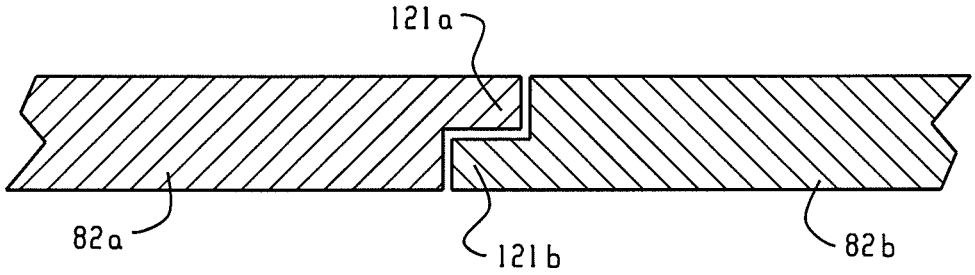

FIG. 10 illustrates a threshold member arrangement where the threshold members 82*a* and 82*b* overlap each other when the doors 74*a* and 74*b* are placed in their closed positions. The threshold members 82*a*, 82*b* include overlap portions 121*a* and 121*b* that overlap each other in a side-by-side arrangement, which creates a somewhat tortuous leak path for liquid to pass therebetween.

Figure 11:
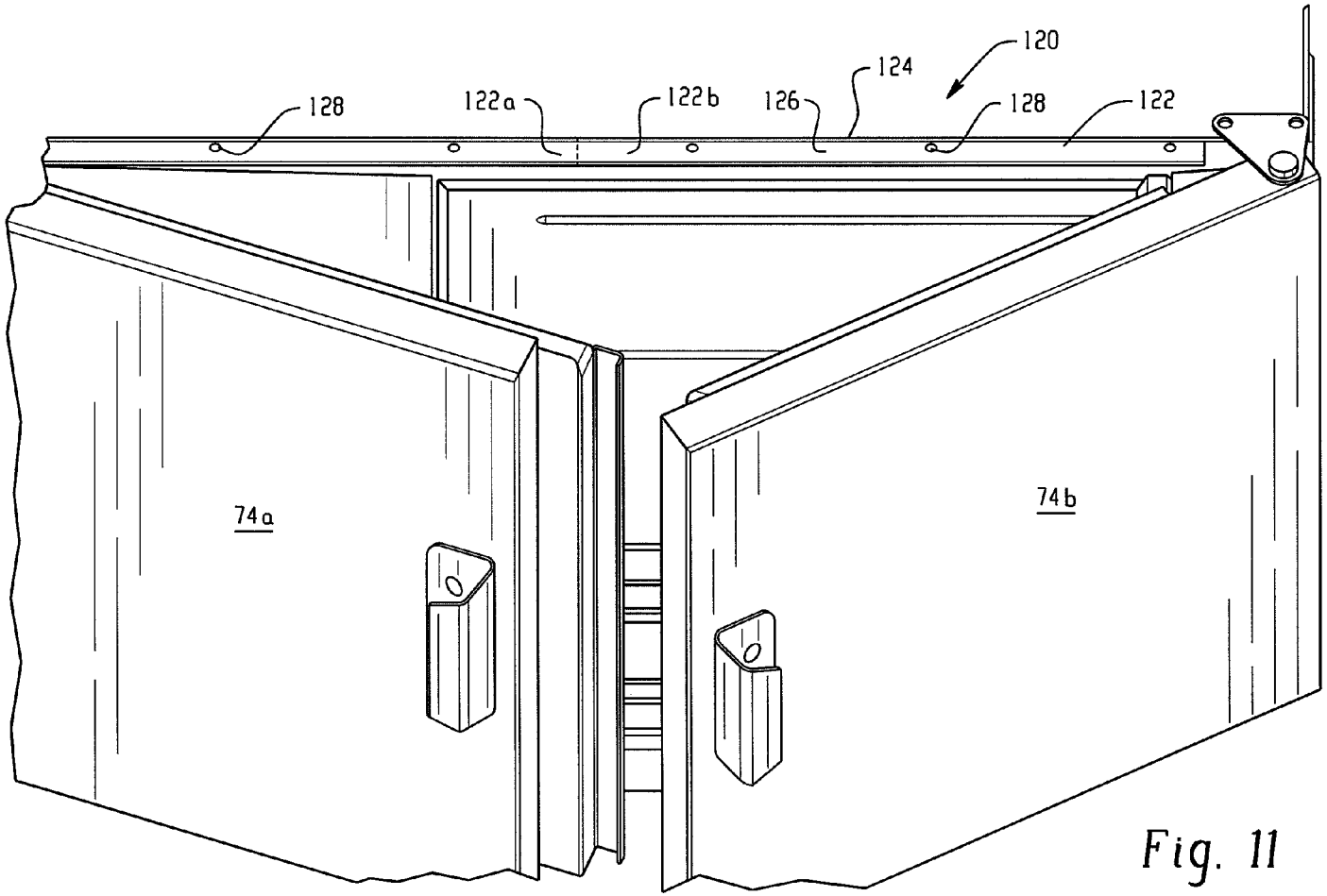

Referring now to FIG. 11, in some embodiments, the warewash section 120 includes a steam deflector 122 that inhibits passage of steam and liquid from the warewash section during use and with the doors 74 closed. The steam deflector 122 is arranged and configured to abut the inside surface of the doors 74 with the doors in their closed positions.

Figure 12:
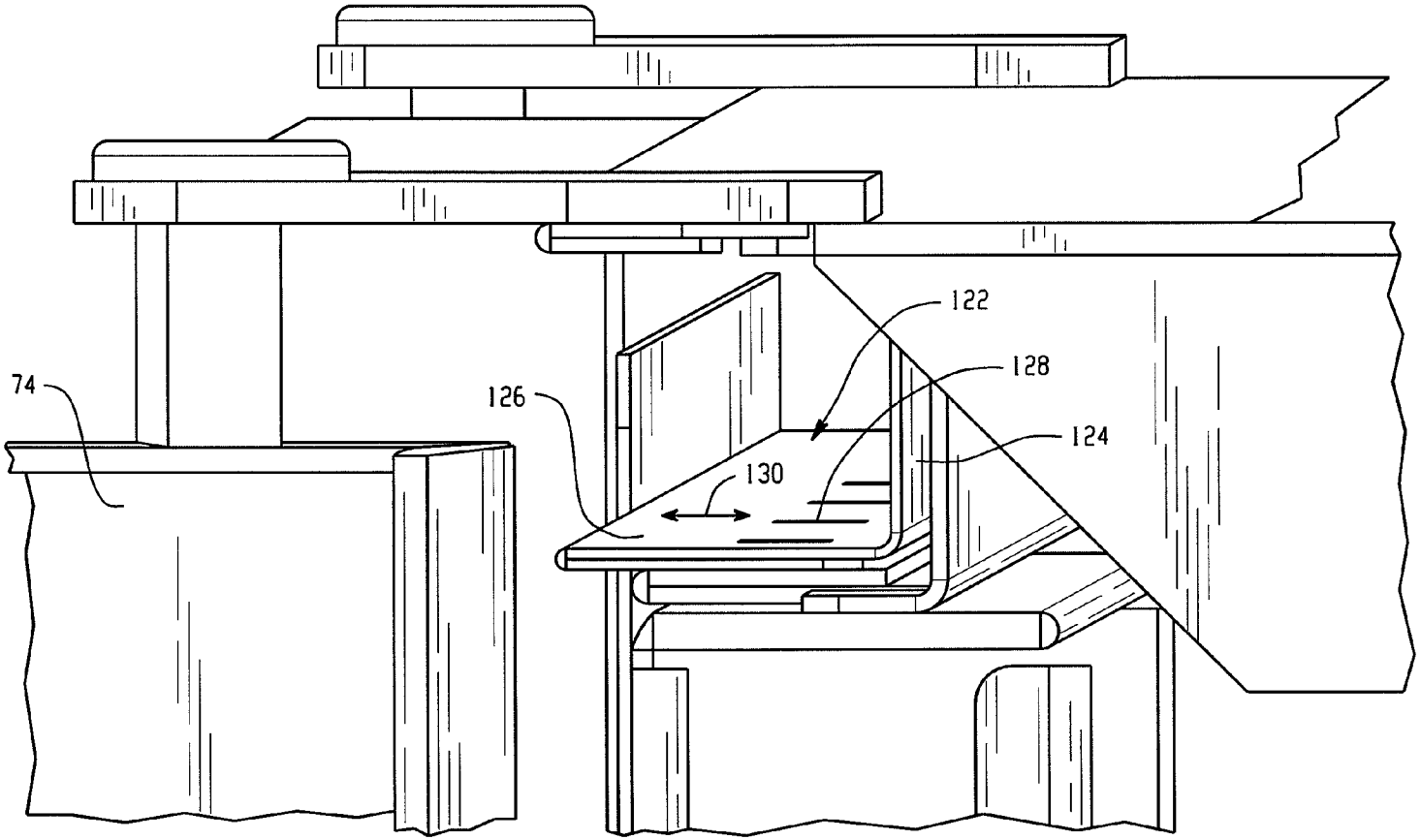

Referring also to FIG. 12, the steam deflector 122 is an L-shaped member (e.g., formed of stainless steel or other suitable material) including a vertical component 124 and a horizontal component 126. The horizontal component 126 is the part of the steam deflector 122 that abuts the doors when they are closed.

Because the doors 74 include the threshold members 82 with embossment 85 (e.g., a downward extended rib) that is sized and arranged to mate with the groove or recess 86 that is formed by tank shelf 87 and the edge seal member 88 that is sized and arranged to mate with the upper edge 90 of tank shelf 87 (FIG. 3), the steam deflector 122 is made adjustable in order to accommodate the sealing engagements between the threshold members 82 of the doors 74. In the illustrated embodiment, the steam deflector 122 includes an array of slots 128 that are sized and arranged to receive fasteners for fastening the steam deflector in the position shown. The slots 128 are elongated to allow for forward and rearward adjustment of the threshold member 122 in the direction of arrow 130 (FIG. 12) to ensure that the steam deflector engages the doors 74 with the threshold members 82 properly mated with the tank shelf 87.

Referring back to FIG. 11, the steam deflector 122 is illustrated as a single, continuous member. However, as represented by the dotted lines, the steam deflector 122 may include two separate members 122*a* and 122*b*, where member 122*a* is associated with door 74*a* and member 122*b* is associated with door 74*b*. Providing two separate members 122*a* and 122*b* allows for independent adjustment of the members based on the closed position of the respective doors. Use of the steam deflector 122 can be used to replace a rubber or plastic upper seal, which can wear over time.

Figure 13:
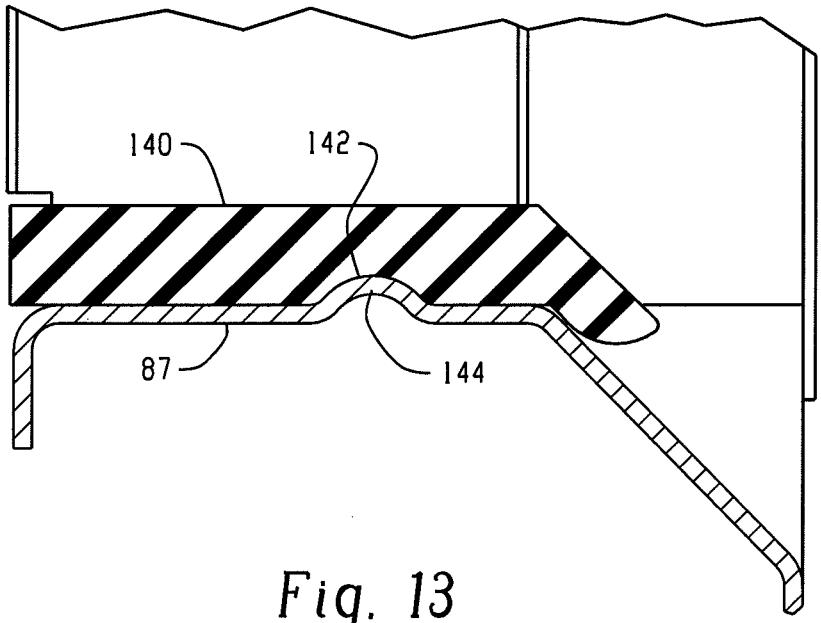
FIG. 13 is a section, detail view of another threshold seal member embodiment with a door in its closed configuration.

It is to be clearly understood that the above description is intended by way of illustration and example only and is not intended to be taken by way of limitation, and that changes and modifications are possible. For example, the above-described door construction may be used in non-conveyor type warewash machines such as box-type machines. Referring to FIG. 13, an alternative arrangement is shown where threshold seal member 140 includes a groove or recess 142 that is sized and arranged to mate with an embossment 144 (e.g., a rib) that is formed by tank shelf 87 to form an embossment seal. Accordingly, other embodiments are contemplated and modifications and changes could be made without departing from the scope of this application.

What is claimed is:

1. A warewasher for washing wares, the warewasher comprising:

a housing defining an internal space with at least one spray zone for washing wares, the housing including an opening defined in part by a lower shelf;

a liquid delivery system that provides a spray of liquid within the spray zone; and an access door having a vertically hinged connection to the housing at one side of the access door to provide an open configuration that allows user access to the spray zone and a closed configuration that inhibits user access to the spray zone, the access door pivots about a vertical axis of the vertically hinged connection when moving between the closed configuration and the open configuration, the access door including a threshold seal member at the bottom of the access door, the threshold seal member formed of hard rubber or plastic and including a lower sealing portion that mates in contact with an upper surface of the shelf to provide a lower seal extending laterally along a width of the access door, and an inner sealing portion that cooperates with an inner edge the shelf to provide an inner seal extending laterally along the width of the access door, the inner seal being located nearer the spray zone than the lower seal, the inner sealing portion extending inward past and downward from the inner edge of the shelf when the door is in the closed configuration, and the inner sealing portion is sized and configured to permit the access door to pivot from the closed configuration to the open configuration by pulling a handle side of the door away from the housing such that the threshold member slides along the shelf causing the door to raise upward during the pivot, wherein the vertically hinged connection is configured to allow for vertical movement of the access door as a result of sliding interaction of the threshold member and the shelf.

2. The warewasher of claim 1, wherein the lower sealing portion is a rib that extends downwardly from a bottom of the threshold seal member, the shelf including a groove that receives the rib with the door in the closed configuration, surface portions of the sealing member inward and outward of the rib are in contact with respective portions of the shelf that are inward and outward of the groove.

3. The warewasher of claim 2, wherein the inner sealing portion is an edge seal member, wherein the edge seal member is sized and configured to extend over the inner edge of the shelf with the door in the closed configuration.

4. The warewasher of claim 3, wherein the access door includes a main body of metal and the threshold seal member is connected at a bottom portion of the main body and extending along the width of the main body.

5. The warewasher of claim 3, wherein the vertically hinged connection includes hinge components configured to be removable from one side edge of the access door to an opposite side edge of the access door so that the access door can be reconfigured from a right-hand opening access door to a left-hand opening access door.

6. The warewasher of claim 5, wherein the access door further includes a graspable handle at the handle side, the handle configured to be removable from the access door so that it can be repositioned on and reconnected to the access door when the access door is reconfigured from the right-hand opening access door to the left-hand opening access door.

7. The warewasher of claim 1, wherein the access door is a first access door, the warewasher further comprising a second access door having a vertically hinged connection to the housing and including a threshold seal member at the bottom of the second access door, the threshold seal member of the second access door including a lower sealing portion that mates with the shelf and an inner sealing portion that cooperates with the inner edge of the shelf.

8. The warewasher of claim 1, wherein a tank is positioned below the spray zone and an upper portion of the tank forms the shelf.

9. The warewasher of claim 1 further comprising a labyrinth seal assembly extending vertically along a vertically oriented edge of the access door, the labyrinth seal assembly including a channel extending along a height of the access door, the channel being in communication with the spray zone so that liquid entering the channel along a leak path formed between the access door and the labyrinth seal assembly with the access door in its closed configuration drains down into the tank.

10. The warewasher of claim 1, wherein the lower sealing portion is a groove that extends inwardly from a bottom of the threshold seal member along the width of the access door, the shelf including a rib that is received by the groove with the door in the closed configuration.

11. A warewasher for washing wares, the warewasher comprising:

a housing defining an internal space with at least one spray zone for washing wares, the housing including an opening defined in part by a lower shelf having a groove therein;

a liquid delivery system that provides a spray of liquid within the spray zone; and an access door having a vertically hinged connection to the housing to provide an open configuration that allows user access to the spray zone and a closed configuration that inhibits user access to the spray zone, the vertically hinged connection permits some vertical movement of the access door along its hinge axis, the access door including a threshold seal member at the bottom of the access door, the threshold seal member including a downwardly extending rib that locates within the groove to provide a lower seal extending laterally along a width of the access door, during opening of the access door via pivoting of the access door about the vertically hinged connection, the rib is sized and configured to interact with the shelf such that the rib rides upward along the shelf and out of the groove causing the door to move vertically upward.

12. The warewasher of claim 11 further comprising an edge seal member, the edge seal member being sized and configured to extend over an inner edge of the shelf with the access door in the closed configuration, wherein during opening of the access door the edge seal lifts from the inner edge of the shelf.

13. The warewasher of claim 11, wherein the vertically hinged connection includes hinge components configured to be removable from one side edge of the access door to an opposite side edge of the access door so that the access door can be reconfigured from a right-hand opening access door to a left-hand opening access door.

14. The warewasher of claim 11, wherein the access door is a first access door, the warewasher further comprising a second access door having a vertically hinged connection to the housing to provide an open configuration that allows user access to the spray zone and a closed configuration that inhibits user access to the spray zone, the vertically hinged connection of the second access door permits some vertical movement of the second access door along its hinge axis, the second access door including a threshold seal member at the bottom of the second access door, the threshold seal member of the second access door including a downwardly extending rib that locates within the groove to provide a lower seal extending laterally along a width of the second access door, during opening of the second access door the rib rides upward along the shelf and out of the groove causing the second access door to move vertically upward.

15. The warewasher of claim 11 further comprising a tank positioned below the spray zone, an upper portion of the tank forms the shelf.

* * * * *